United States Patent [19]

Viro et al.

[11] 4,036,643

[45] July 19, 1977

[54] DIFFUSION TRANSFER COLOR PROCESS USING LACTONE OR SULTONE RING CONTAINING LIPOPHILIC NON-DIFFUSING COLOR FORMERS WHICH YIELD DIFFUSING DYES

[75] Inventors: Felix Viro, Apalachin; Michael C. Mourning, Vestal, both of N.Y.

[73] Assignee: GAF Corporation, New York, N.Y.

[21] Appl. No.: 520,128

[22] Filed: Nov. 1, 1974

Related U.S. Application Data

[63] Continuation-in-part of Ser. No. 368,976, June 11, 1973, abandoned.

[51] Int. Cl.[2] ..... G03C 7/00; G03C 5/54; G03C 1/40; G03C 1/71

[52] U.S. Cl. ..... 96/29 D; 96/3; 96/56.3; 96/56.4; 96/56.5; 96/56.6; 96/74; 96/77; 96/100

[58] Field of Search ..... 96/3, 29 D, 74, 77, 96/100, 56.5, 56.6, 56.3, 56.4

[56] References Cited

U.S. PATENT DOCUMENTS

| | | | |
|---|---|---|---|
| 2,673,800 | 3/1954 | Meeussen et al. | 96/3 |
| 3,311,476 | 3/1967 | Loria | 96/55 |
| 3,320,063 | 5/1967 | Bloom | 96/3 |
| 3,415,652 | 12/1968 | Porter | 96/100 |
| 3,443,940 | 5/1969 | Bloom et al. | 96/3 |
| 3,447,928 | 6/1969 | Loria | 96/56.4 |
| 3,647,436 | 3/1972 | Bosh | 96/77 |
| 3,837,854 | 9/1974 | Waxman et al. | 96/74 |
| T900,012 | 7/1972 | Williams | 96/3 |

*Primary Examiner*—David Klein
*Assistant Examiner*—Richard L. Schilling
*Attorney, Agent, or Firm*—Walter C. Kehm; Edward G. Comrie

[57] ABSTRACT

Lipophilic non-diffusing color formers yielding diffusing dyes are employed in color transfer systems to provide improved diffusion and better quality of color. The color formers are two-equivalent couplers having in the coupling position acyloxy, or sulfonyloxy groups which complete a lactone or sultone ring, respectively, and are stable to hydrolysis under alkaline development conditions. Color-providing material is created by a reaction which opens the lactone or sultone intramolecular ring after the non-diffusing color former reacts with the oxidized color developer molecule. Examples are given of intramolecular 2-equivalent couplers which react with the developer to give yellow, magenta and cyan dyes. The 2-equivalent color formers are unique since they have an intramolecular lactone or sultone ring which opens under oxidative coupling conditions to yield the diffusible yellow, magenta and cyan dyes.

14 Claims, 11 Drawing Figures

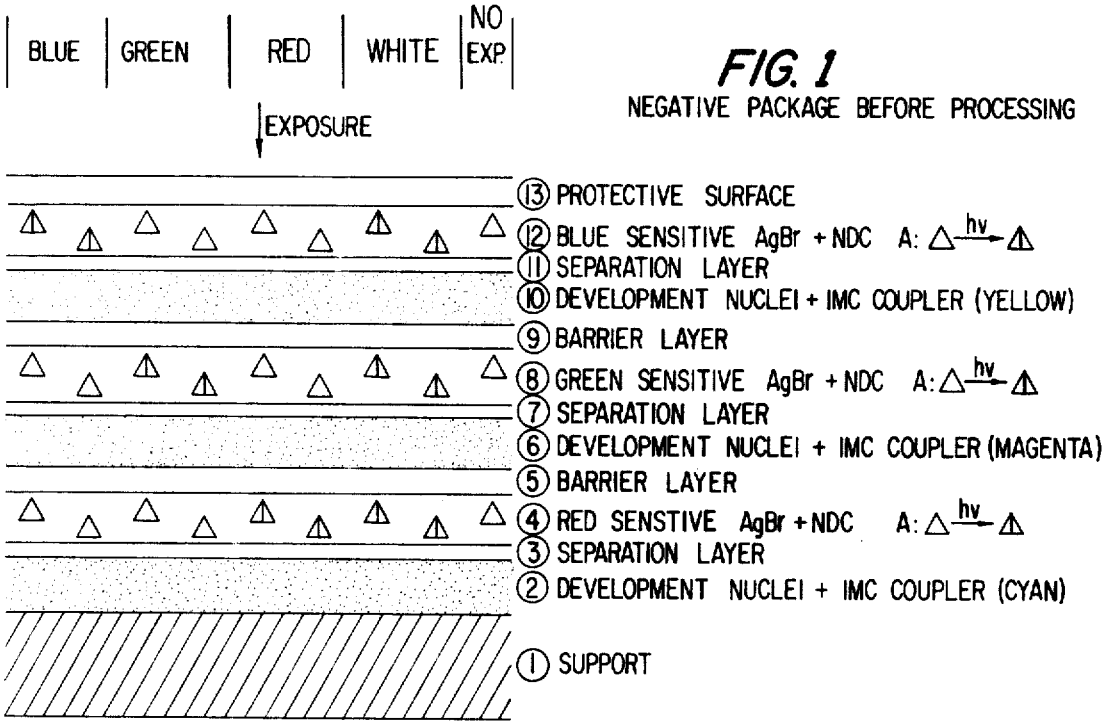
FIG. 1
NEGATIVE PACKAGE BEFORE PROCESSING
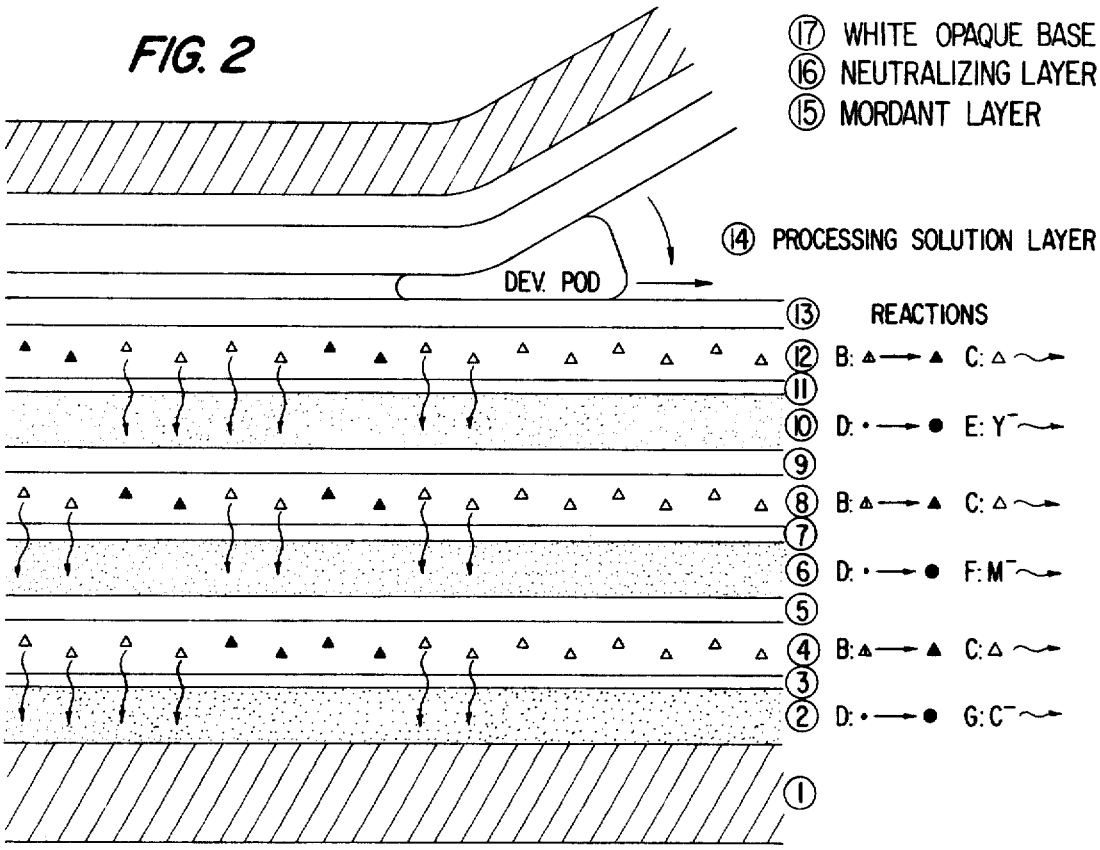
NEGATIVE PACKAGE DURING PROCESSING FIG. 3
DYE IMAGE TRANSFER STEP
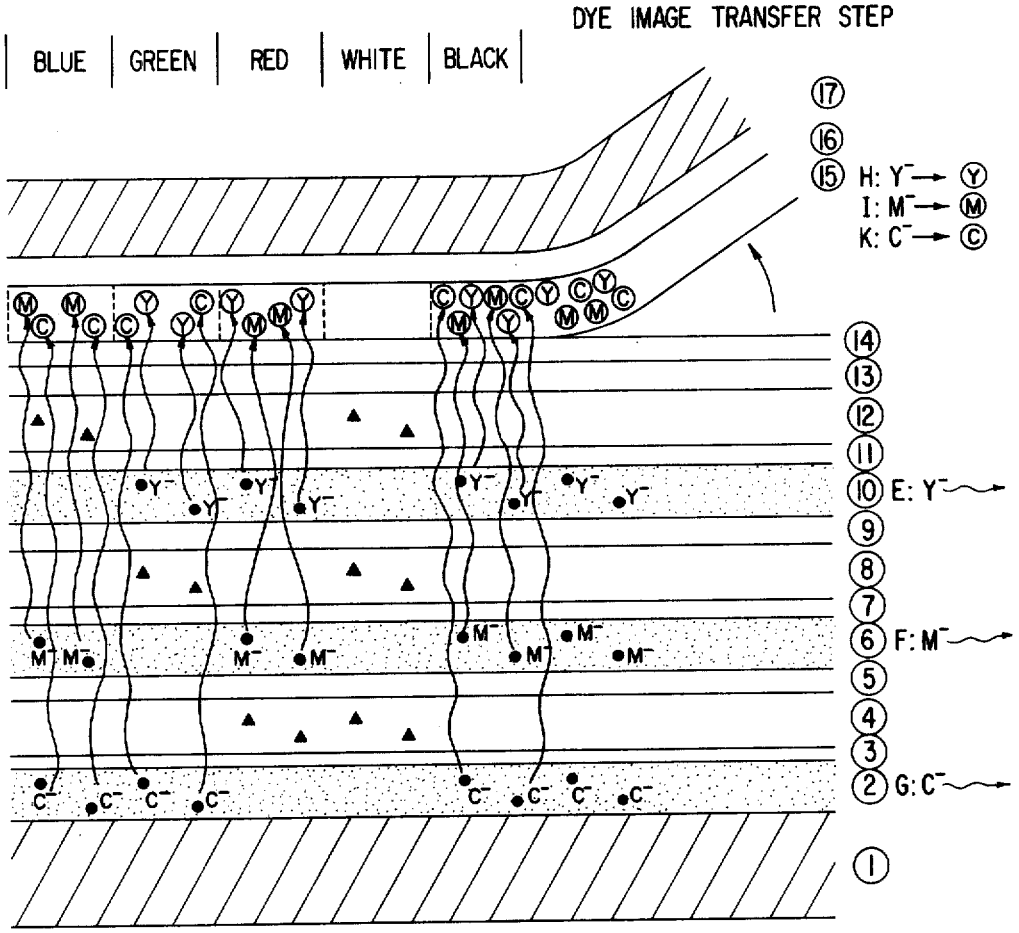
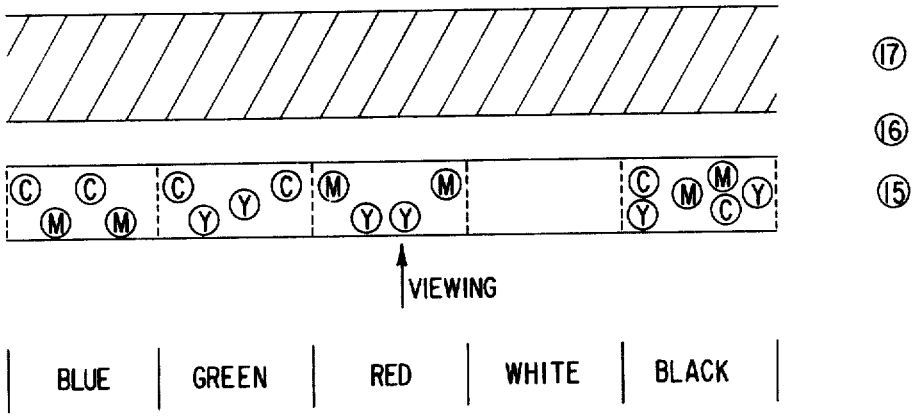
FIG. 4 RECEIVING SHEET AFTER TRANSFER FIG. 5
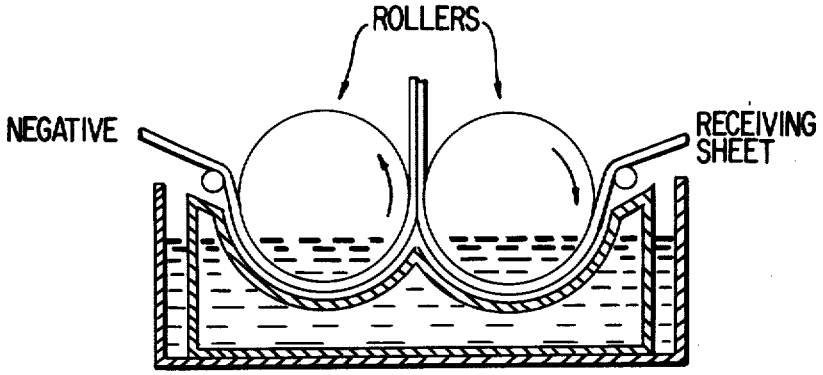
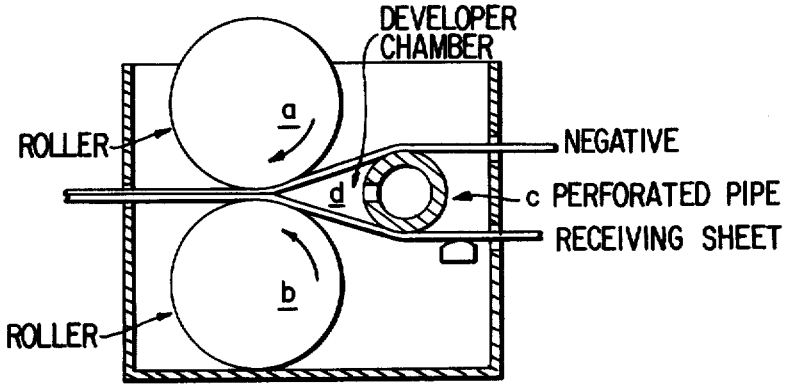
FIG. 6

FIG. 10

REACTIONS:

A $AgBr \xrightarrow{h\nu} AgBr^*$ $\triangle \longrightarrow \triangle$

B $AgBr^* + DEV \longrightarrow Ag^\circ + DEV^* + Br^-$
$DEV^* + NDC \longrightarrow NDD$ $\triangle \longrightarrow \blacktriangle$ C $AgBr + S_2O_3^= \longrightarrow AgS_2O_3^- + Br^-$ $\triangle \rightsquigarrow$ D $AgS_2O_3^- + Ag + DEV \longrightarrow 2Ag^\circ + S_2O_3^= + DEV^*$ $\bullet \longrightarrow \bullet$ E $DEV^* +$ IMC COUPLER (YELLOW) $\longrightarrow$ DIFFUSING YELLOW DYE $Y^-$ F $DEV^* +$ IMC COUPLER (MAGENTA) $\longrightarrow$ DIFFUSING MAGENTA DYE $M^-$ G $DEV^* +$ IMC COUPLER (CYAN) $\longrightarrow$ DIFFUSING CYAN DYE $C^-$ H $MORDANT^+ + Y^- \longrightarrow MORDANT-Y$ $Y^- \rightarrow Y$ I $MORDANT^+ + M^- \longrightarrow MORDANT-M$ $M^- \rightarrow M$ K $MORDANT^+ + C^- \longrightarrow MORDANT-C$ $C^- \rightarrow C$

SYMBOLS:

$AgBr$ - LIGHT SENSITIVE SILVER HALIDE
$AgBr^*$ - EXPOSED SILVER HALIDE
DEV - COLOR DEVELOPER(A P-PHENYLENE DIAMINE)
$DEV^*$ - OXIDIZED COLOR DEVELOPER
NDC - NON-DIFFUSING COUPLER
NDD - NON-DIFFUSING DYE
$Ag^\circ$ - METALLIC SILVER (DEVELOPMENT NUCLEI)
$S_2O_3^=$ - THIOSULFATE (SILVER HALIDE SOLVENT)

IMC COUPLER - INTRAMOLECULARLY CYCLIZED COUPLER, TWO EQUIVALENT, NON-DIFFUSING $Y^-, M^-, C^-$ - DIFFUSING YELLOW, MAGENTA AND CYAN DYES FORMED BY COUPLING

MORDANT-Y,-M,-C - NON-DIFFUSING MORDANTED YELLOW, MAGENTA AND CYAN DYES

DIFFUSION TRANSFER COLOR PROCESS USING LACTONE OR SULTONE RING CONTAINING LIPOPHILIC NON-DIFFUSING COLOR FORMERS WHICH YIELD DIFFUSING DYES

CROSS-REFERENCE TO RELATED APPLICATION

This is a continuation-in-part of our copending application Ser. No. 368,976, filed June 11, 1973, now abandoned.

The present invention relates to color photography, and more particularly to color diffusion, transfer photographic processes and materials.

Color diffusion transfer processes are known employing a photographic element containing at least one silver halide emulsion layer, and in the same layer as the silver halide or adjacent thereto, a color providing substance which is immobile but which by oxidative coupling during development with color developing agent during treatment of the exposed element creates an imagewise distribution of diffusing dye species, with resulting diffusion of the desired color dye into an adjacent receiving layer. Usually three emulsions, each sensitized to a different region of the visible spectrum, are provided and a different color providing substance is provided for each, these being known as color couplers and forming azomethine, indo-aniline and indophenol dyes with the oxidation products of a silver halide color developing agent.

Color couplers are classed as 2-equivalent or 4-equivalent couplers. The present invention is based on the use of a transient heterocyclic color coupling compound in the form of a lactone or sultone of a 2-equivalent coupler, the carboxylic or sulfonic acid radical, respectively, of said transient heterocyclic color coupling compound being linked to the carbon atom of the coupling position thereof. These coupling compounds may also be designated as intramolecularly cyclized color formers. The transient heterocyclic color coupling compound is water-insoluble and is resistant to splitting of the lactone or sultone ring in aqueous alkaline solution in the absence of oxidative coupling. When the exposed photographic element containing the transient heterocyclic color coupling compound is developed with a color developer, such as a p-phenylenediamine color developer, at alkaline pH, the transient heterocyclic color coupling compound reacts with oxidized color developer, via a ring opening reaction, to form an imagewise distribution of water-soluble and diffusible dye, the diffusibility being imparted to the dye by formation of a free carboxylic or sulfonic acid group as a result of the ring opening. The diffusible dye diffuses to and is mordanted in a receiving sheet, as is known.

In a preferred embodiment of the invention, the heterocyclic color coupling compound may be a compound of the formula:

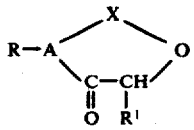

I.

-continued

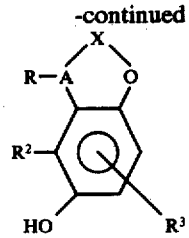

II.

or

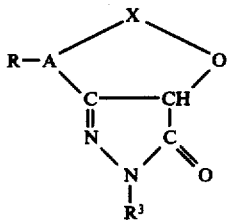

III.

wherein

X is $-\overset{O}{\overset{\|}{C}}-$ or $-\overset{O}{\overset{\|}{\underset{O}{S}}}-$;

A is a chain of 1 to 3 atoms containing only carbon atoms in the chain or containing up to 1 nitrogen atom for chains of 2 to 3 atoms;

R is attached to and satisfies the valences of the atoms in A and is independently one or more hydrogen, an aliphatic radical or an aromatic radical, or R is an aromatic radical and A is provided by two adjacent carbon atoms in an aromatic ring of R;

$R^1$ is an activating group; and $R^2$ and $R^3$ are independently hydrogen, halogen, cyano, an aliphatic radical or an aromatic radical, or R, $R^2$ and A together form a benzene ring fused to the benzene ring to which A and $R^2$ are attached.

Preferably, A will have one or two atoms in the chain to provide a 5- or 6-membered lactone or sultone ring, namely,

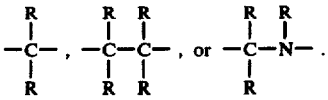

The R groups are preferably hydrogen, alkyl, phenyl and alkyl- or alkoxy-phenyl. When R is aromatic and A is provided by two adjacent carbon atoms in an aromatic ring of R, it is preferred that R is phenyl or naphthyl, either unsubstituted or substituted by one or more halo, cyano, alkyl, alkoxy, phenyl or phenoxy. $R^1$ may be any activating group associated with a keto-methylene coupler, such as cyano, acyl, alkoxyacyl, or aminoacyl. $R^2$ and $R^3$ are preferably hydrogen, chloro, bromo, alkyl, alkoxy, aliphatic or aromatic acylamino, phenyl, phenoxy, or phenyl substituted by halo, cyano, alkyl, alkoxy or phenyl or phenoxy.

Other preferred heterocyclic color coupling compounds of the invention are shown below:

Yellow Color Formers

-continued

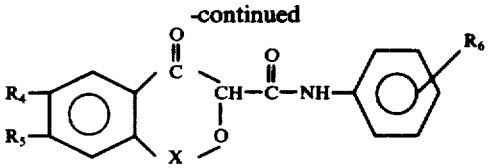

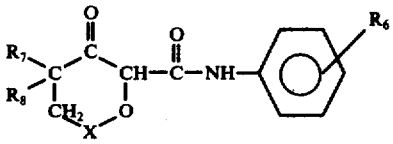

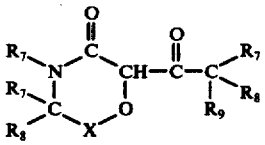

Magenta Color Formers

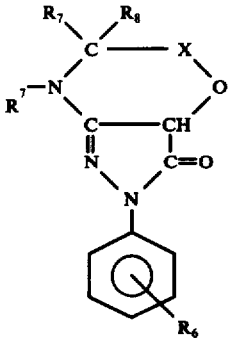

-continued

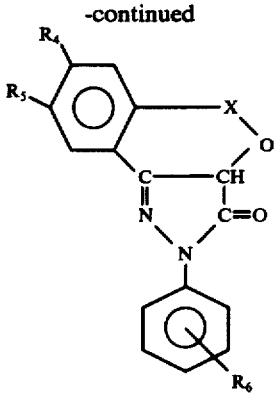

Cyan Color Former

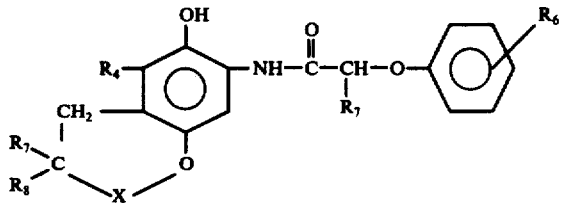

wherein

X is $-\overset{O}{\overset{\|}{C}}-$ or $-\overset{O}{\overset{\|}{\underset{O}{S}}}-$ $R_4$ and $R_5$ are independently hydrogen, halogen, alkyl, alkoxy, phenyl, phenoxy, or phenyl substituted by halo, cyano, alkyl, alkoxy, phenyl or phenoxy, or $R_4$ and $R_5$ together form a napthalene ring with the benzene ring to whch they are attached;

$R_6$ is hydrogen, halo, cyano, alkyl, alkoxy, phenyl or phenoxy; and $R_7$, $R_8$ and $R_9$ are independently hydrogen, alkyl, alkoxy, alkanoyl, phenyl, phenoxy, or phenyl substituted by halo, cyano, alkyl, alkoxy, phenyl or phenoxy;

said alkyl, said alkoxy and said alkanoyl for $R_4$-$R_9$ having up to 6 carbon atoms.

Set forth below are reactions in which typical heterocyclic color coupling compounds of the invention are converted to diffusing dyes by coupling with oxidized color developer D:

Yellow Color Formers

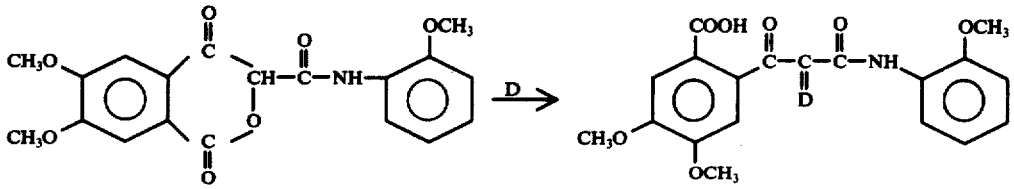

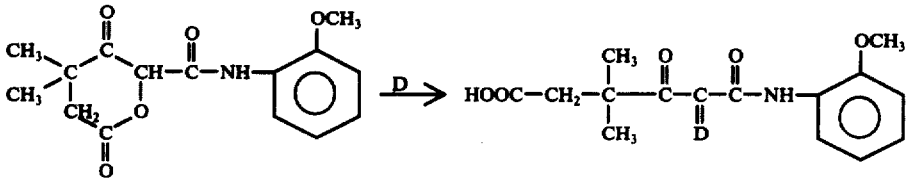

-continued

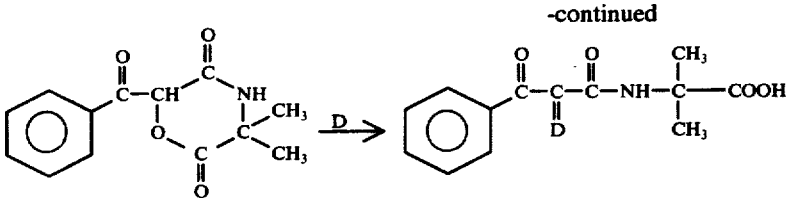

Magenta Color Formers

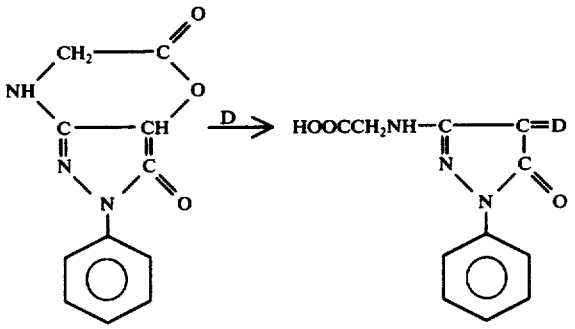

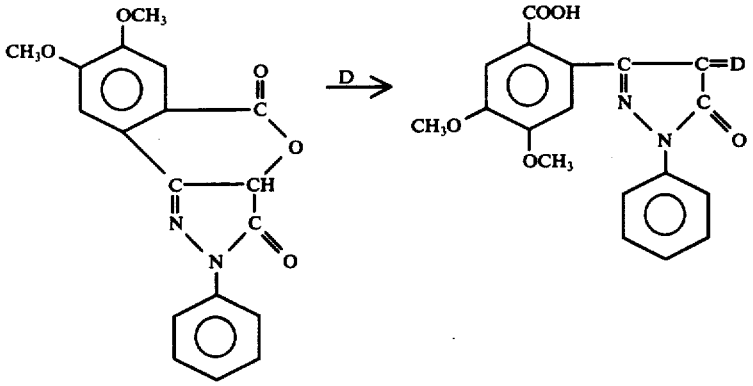

Cyan Color Former

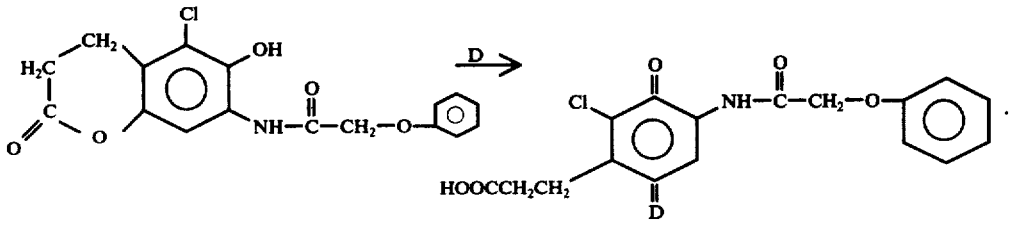

The heterocyclic color coupling compounds of the present invention may be used in negative working as well as positive working transfer systems. Although the following description emphasizes the advantages of the "silver stream" positive system which is preferred, the scope of the invention is not restricted to the preferred silver stream system and the novel compounds of the invention and examples can be incorporated into a conventional silver halide emulsion to give a negative transfer image or into a direct positive emulsion to give a positive transfer image.

PREFERRED SILVER STREAM PACKAGE STRUCTURE

This process for the preferred silver stream package structure employs as the negative photosensitive package blue, green, and red sensitized silver halide emulsions in gelatin or similar colloid members, each having an adjacent and companion color-providing nucleating colloid layer and each being separated from the nucleating colloid layers companion to the other photosensitive members by a distance of at least 3 up to 6 microns. This separation is effected by the inclusion of the appropriate number of inert gelatin layers of 3 up to 6 microns thickness each. The photosensitive members comprise the aforesaid silver halide emulsions sensitized to the proper primary color range with known sensitizing dyes. For negative development with a p-phenylene diamine developer, the photosensitve members are preferably comprised of two layers; one layer containing the silver halide emulsion in gelatin or similar colloid along with a scavenger for oxidized p-phenylene diamine such as a non-diffusing color former of any hue producing species (such color formers are known); and another very thin (less than one micron) layer of an inert gel interposed between the silver halide emulsion in gelatin or similar colloid layer and the companion nucleating colloid layer. This preferred embodiment has the advantages of both restricting the oxidized product of p-phenylene diamine negative development to the developing layer and enhancing the development power of the p-phenylene diamine type developer.

Each of the nucleating colloid layers which is associated with the blue, green and red sensitized layer, respectively, is provided with a two-equivalent colorless non-diffusing coupler of the invention capable of ultimately reacting with and converting the left-over silver halide positive image by a physical color development process in the adjacent layer only to a soluble, diffusible positive color image of a hue complementary to the hue of the light registered in the negative record: namely, yellow which is associated with the blue sensitive silver halide member; magenta which is associated with the green sensitive silver halide member; and cyan which is associated with the red sensitive silver halide member.

More specifically, the two-equivalent colorless non-diffusing couplers of the invention react with oxidized color developer (p-phenylene diamine type) which, in turn, is produced in a physical development involving colloidal dispersions of noble metals or their sulfides, (but preferably colloidal silver of a size appropriate to its co-utilization as a yellow filter (Carey-Lea silver for example) during the exposure step), p-phenylene diamine developer saturating the system during the transfer step, and undeveloped silver halide from the adjacent layer comprising the positive residue of the negative development. During the coupling reaction, the lactone or sultone ring is opened, and the coupled product becomes diffusible by virtue of the free COOH or $SO_3H$ group. Thus, the initial non-diffusible colorless coupler of the invention is converted to a cyan, magenta, or yellow dye, appropriate to the layer involved, by the color providing reaction, which simultaneously with color formation imparts solublity and diffusiblity in the swollen gelatin matrix to the colored coupled product.

The couplers of the invention also have the advantage of being colorless before oxidative coupling and thus do not interfere with the transparency of the other than silver halide portions of the photosensitive package towards exposing by actinic light.

This invention contemplates negative and positive working systems in accordance with the examples given hereinafter and the drawings.

DRAWINGS AND EXAMPLES

The invention will be more readily understood by reference to the examples which follow and to the accompanying drawings, in which:

FIG. 1 shows the exposure of the novel negative three-color package of the invention before processing with color developer and silver halide solvent;

FIG. 2 shows the condition of the negative package of FIG. 1 after exposure and negative development showing the three only intranegative transfers of silver.

FIG. 3 shows the negative package of FIG. 2 during the step in which the dye image is transferred from the negative package to the mordanting receiving sheet;

FIG. 4 shows the recreation of the original scene on the receiving sheet.

FIG. 5 is a schematic representation of a developing chamber and rollers with explanatory legends showing the contacting of the negative material with the receiving sheet;

FIG. 6 illustrates another embodiment of the developing chamber and rollers for the same purposes as the embodiment of FIG. 5;

FIG. 10 is a summary of the photochemical reactions and explanation of the symbols which occur in the photosensitive elements of FIG. 1–4.

Figure 7:
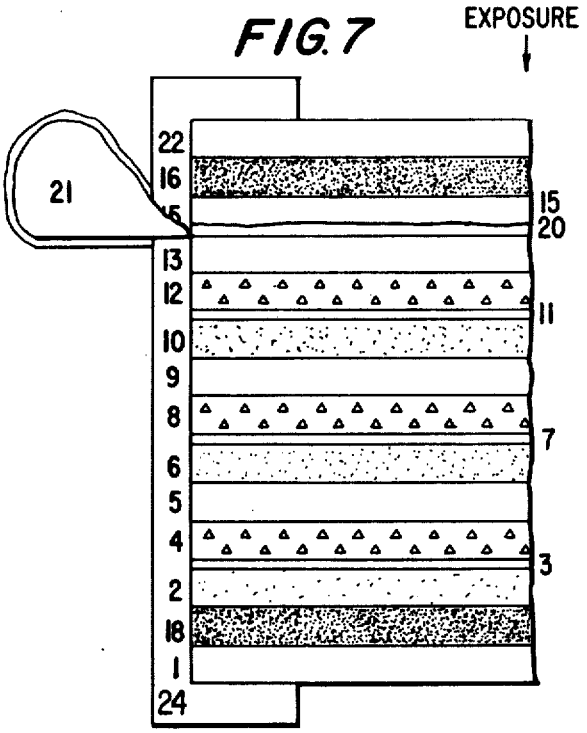
FIG. 7 shows a permanently bound element consisting of the light sensitive negative material, receiving sheet and a developer pod to be used in a lateral reversal corrected camera, and allowing completion of development outside the confines of the camera.
Figure 9:
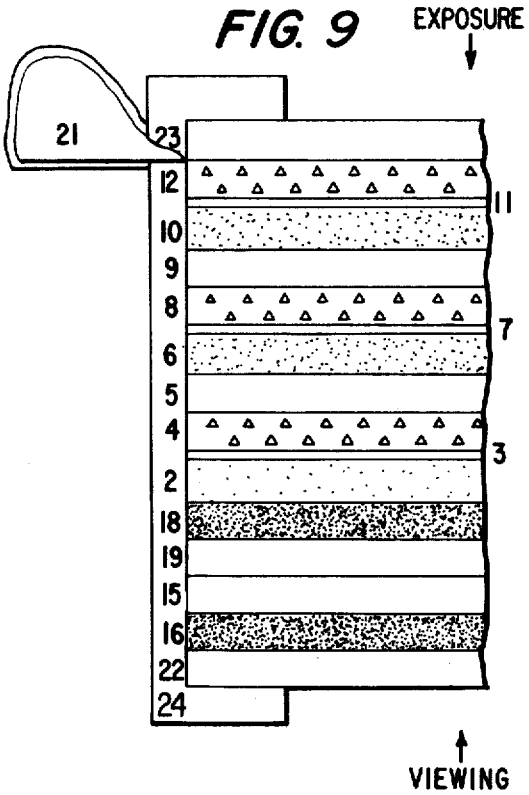
FIG. 9 shows a permanently bound element consisting of the light sensitive negative material, receiving sheet and a developer pod to be used in a camera with conventional optics with no lateral reversal correction, and allowing completion of development outside the confines of the camera.
Figure 8:
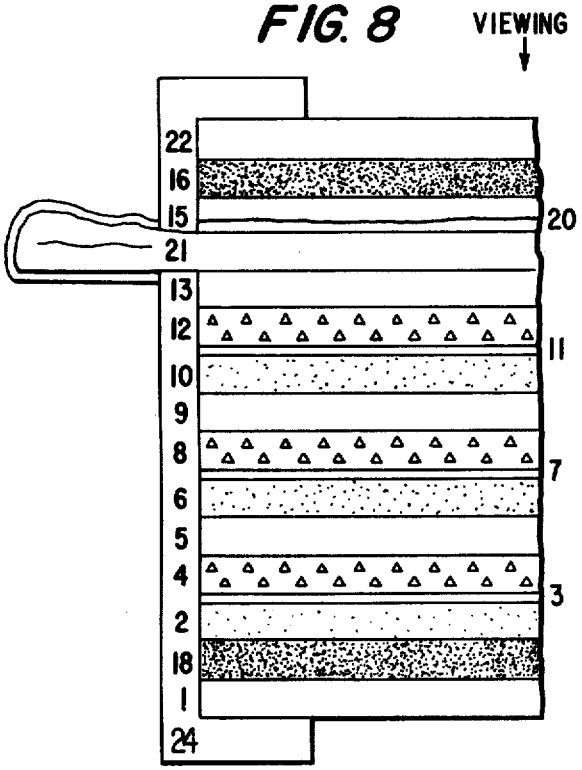
FIG. 8 shows the same element after exposure and processing.

Each of FIGS. 1–4, inclusive, includes legends explaining the chemical reaction occurring in each of the layers and symbols which are used to signify the chemical reagents.

The following structural features are illustrated in the drawings herein:

The negative photosensitive package is coated on a support base 1 which can be either a film base such as a polyester or thermoplastic cellulosic film base material or a baryta coated paper or polyethylene-laminated-paper base which base is prepared for the silver halide gelatin or colloid coating by a surface preparation known in the art as "subbing".

Layer 2 is a gelatin or a gelatin substitute matrix containing development nuclei which are collodial particles of noble metals or noble metal sulfides and a two-equivalent non-diffusing intramolecularly cyclized coupler of the invention which via the mechanism described above for ring opening by coupling is capable of forming for solubilization and diffusion in the alkaline swollen matrix a cyan dye. The two-equivalent non-diffusing intramolecularly cyclized coupler is preferably dispersed in a high boiling organic solvent or plasticizer to form minute droplets which are uniformly distributed throughout the matrix of layer 2.

Layer 3 is a gelatin or gelatin substitute matrix of 0.5–1.0 micron thickness which has a primary purpose of blocking the transfer of oxidized developer from layer 4 thereby protectively sealing layer 2 against such transfer; and for this end, layer 3 may contain well known hydroquinone derivatives which are used as anti-oxidants to react with any migrating oxidized developer which may under extreme conditions impinge on layer 3.

Layer 4 is a light sensitive silver halide layer which is sensitized to red light, and layer 4 comprises enough of a conventional non-diffusing color coupler or colorless coupler whose sole purpose in the invention is to scavenge all of the oxidized color developer produced in the fully exposed areas of this layer.

Layer 5 is a gelatin or gelatin substitute layer of from 3 to 6 microns thickness whose purpose is to maintain the distance parameters to be found among the teachings of our invention.

Layer 6 has the same function and composition as does layers 2 except for the substitution of a magenta 2-equivalent non-diffusing intramolecularly cyclized coupler of the invention for the cyan 2-equivalent non-diffusing intramolecularly cyclized coupler.

Layer 7 has the same function and composition as layer 3 and seals layer 6 from any extraneous migration of oxidized developer out of layer 8.

Layer 8 is a light sensitive silver halide layer as is layer 4 but is sensitized to serve as the green record.

Layer 9 is identical in composition and function to layer 5 and serves to maintain the distance parameters among the teachings of our invention.

Layer 10 has the same function and composition as does layer 2 except for the substitution of a yellow 2-equivalent non-diffusing intramolecularly cyclized coupler of the invention for the cyan 2-equivalent non-diffusing intramolecularly cyclized coupler. This layer also contributes filtering protection to the photosensitive layers 4 and 8 against blue light during the exposure step.

Layer 11 has the same function and composition as layer 3 and seals layer 10 from any extraneous migration of oxidized developer out of layer 12.

Layer 12 is a light sensitive silver halide layer like layer 2 except that in this case the silver halide is not optically sensitized and therefore is blue light sensitive only.

Layer 13 is a gelatin or gelatin substitute matrix layer for the purpose of physical protection for the negative package.

In FIG. 2, the receiving sheet is coated on a white opaque base 17 such as titanium oxide pigmented film base or baryta coated paper or a polyethylene-laminated paper base which has been prepared for coating by a subbing process.

Layer 16 is a gelatin or gelatin substitute layer which contains encapsulated organic acids or non-diffusing organic acids, anhydrides or lactones, in concentrations sufficient to neutralize the alkali spread as layer 14 from the developer pod.

Layer 14 is spread out from the developer pod between the mordant layer 15 containing a hydrophilic matrix material capable of mordanting the acid dyes and the protection surface 13 of the negative material. The processing solution contains enough alkali and buffer to maintain a pH of greater than 10.3 during the lifetime of the transfer process, enough color developer and auxiliary aids to develop the light struck areas and function with the two-equivalent non-diffusing intramolecularly cyclized couplers, and the critically small concentration of silver solvent (below 10 grams/liter, but preferably below 2 grams/liter) within the teachings of our invention. The liquid layer 14 also contains enough water to penetrate and swell all of the layers 2–13 in the negative material and the layers 15–16 in the receiving sheet. In addition to these other components, the processing composition may contain viscosity increasing substances, e.g., thickening agents such as methyl cellulose, polyvinyl alcohol, carboxy methyl cellulose, polyvinyl pyrrolidone, etc.

Layer 18 is a gelatin or similar colloid matrix layer containing carbon black or other pigments in concentrations to provide sufficient density to protect underlaying light sensitive layers from further exposure to active light when removed from camera.

Layer 19 is a gelatin or similar colloid matrix layer containing $TiO_2$ or other white opacifying agent in concentration sufficient to form a white reflective layer covering layer 18.

Layer 20 is an auxiliary layer containing $TiO_2$ in concentrations insufficient to prevent exposure of the underlaying photosensitive layers by actinic radiation, and in concentrations sufficient subsequent to processing, to mask opacifying agent distributed in the processing composition from pod 21

Layer 21 is a pressure rupturable pod containing a p-phenylene diamine color developer, antioxidant, alkali, thickening agent, $TiO_2$ and carbon black in such concentrations as to assure full development of all silver halide in fully exposed areas and when spaced evenly between layer 13 and 20 will form an opaque layer sufficient in density to protect underlaying light sensitive layers from further exposure to actinic light when removed from camera.

Layer 22 is a transparent film base such as polyester, polycarbonate, cellulose acetate and the like with a thickness of 2 ½ to 9 mils.

Layer 23 is a transparent film base similar to layer 22.

FIG. 24 is a pressure sensitive binding layer to hold the negative element permanently bound to the image receiving element on cover sheet and to the processing pod.

Figure 11:
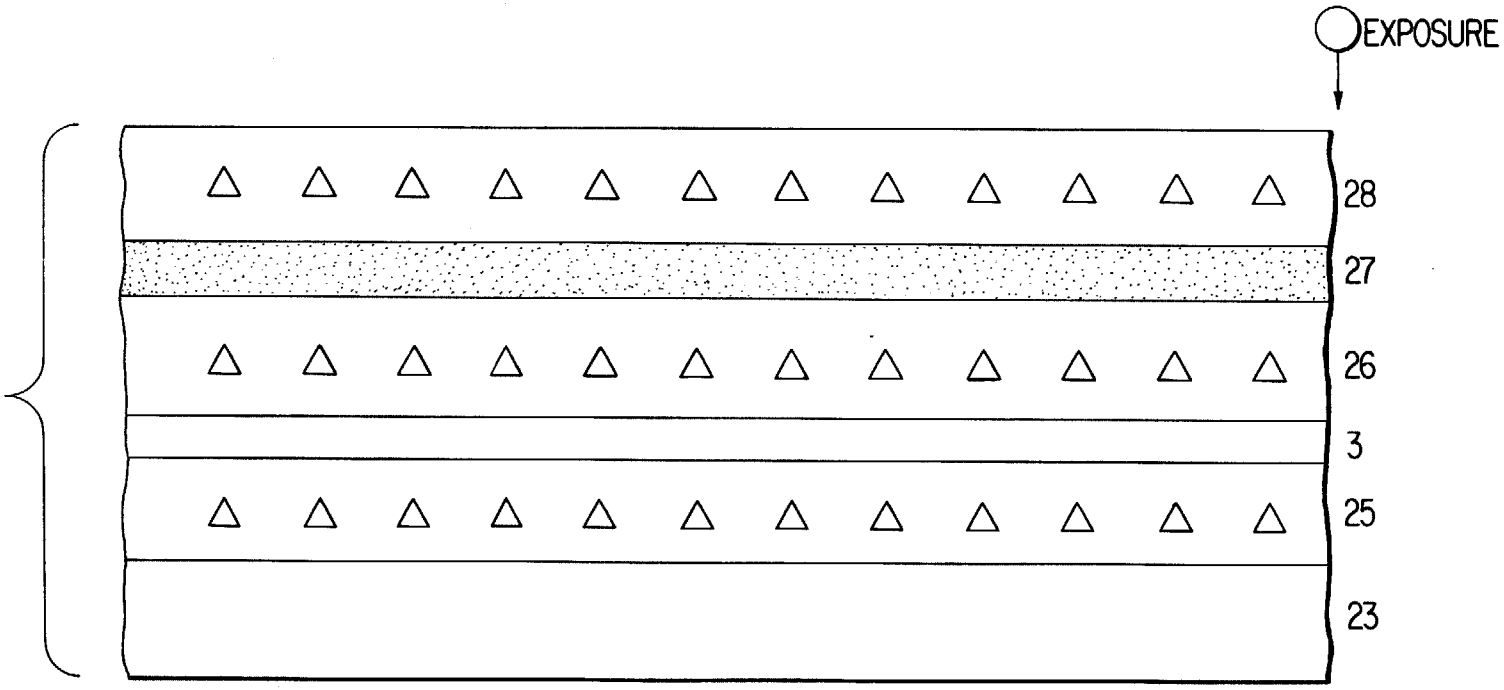
FIG. 11 shows the configurations of an instant color negative or direct positive material utilizing intramolecularly cyclized couplers incorporated in the emulsion layers.

The additional layer 25 and 28 in FIG. 11 are defined as follows:

25 Silver halide layer sensitized to red light and containing a cyan Intramolecularly Cyclized Coupler.

26 Silver halide layer sensitized to green light and containing a magenta Intramolecularly Cyclized Coupler.

27 Yellow filter layer coated to a blue density of 0.9–1.2.

28 Blue light sensitive silver halide emulsion layer containing a yellow Intramolecularly Cyclized Coupler.

In connection with layers 25–28, note that FIG. 11 illustrates the novel embodiment in which a conventional silver halide emulsion provides a negative working system.

The same package arrangement of FIG. 11 can be used with a direct positive emulsion as shown in U.S. Pat. Nos. 2,501,307 and 3,635,707, and thereby provide a positive working system.

Having thus described the structural elements, we now turn to the specific Intramolecularly Cyclized color formers which are an essential part of the present invention.

EXAMPLES OF COLOR FORMERS

The cyan color formers are as follows:

3-(2-Carboxy-1-phenyl)ethylhydroquinone lactone.

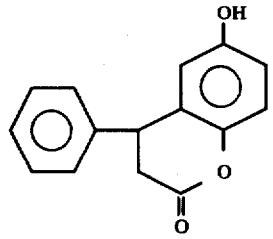

Compound A

For method see Ref. J. D. Simpson & H. Stephen, J. Chem. Soc., 1382 (1956).

2-Acetamido-6-chloro-5-(2-carboxyethyl) hydroquinone lactone.

Compound B

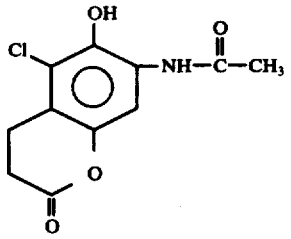

Homogentistic acid lactone.

Compound C

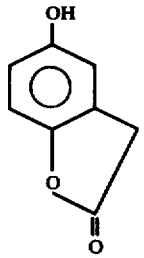

Preparation - see Ref. L. D. Abbott, Jr., and J. D. Smith, J. Biol. Chem., 179, 365 (1949).

2,6-Dibromo-3-(2-carboxy-1-phenylethyl)hydroquinone lactone.

Compound D

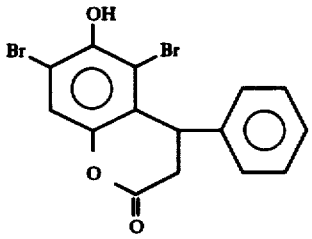

Analogy method W. Borsche, Ber., 40, 2731 (1907).

5,7-Dibromo-6-hydroxy-3,4-dihydrocoumarin.

Compound E

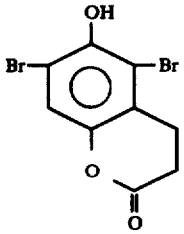

Analogy method W. Borsche, Ber., 40, 2731 (1907).

The 2-equivalent magenta color formers are in two families, a first family the family of pyrazolone lactones and a second family of beta-keto nitriles having a carboxylic group (phenyl or naphthyl) fused into a lactone ring having an isocoumarin structure.

The following are typical examples:

3-(2-Carboxyphenyl)-4-hydroxy-5-oxo-1-phenyl-2-pyrazoline lactone.

Compound F

-continued

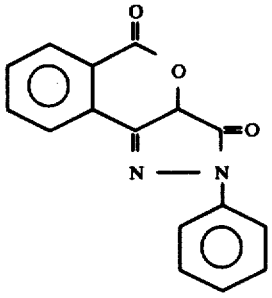

3-(N-carboxymethyl)amino-4-hydroxy-5-oxo-1-phenyl-2-pyrazoline lactone.

Compound G

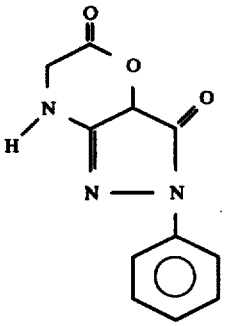

3-(2-carboxyethyl)-4-hydroxy-5-oxo-1-phenyl-2-pyrazoline lactone.

Compound H

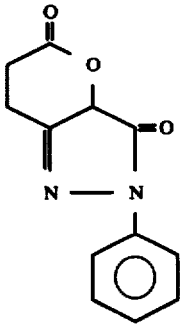

3-(N-phenyl-N-carboxymethyl)amino-4-hydroxy-5-oxo-1-phenyl-2-pyrazoline lactone.

Compound I

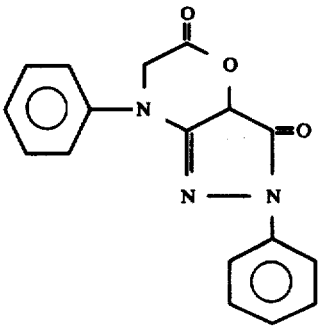

α-(3-carboxy-2-naphthoyl)-α-hydroxy-acetonitrile lactone.

Compound J

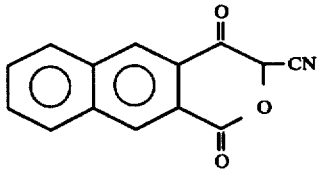

3-(N-carboxymethyl)butylamido-4-hydroxy-5-oxo-1-phenyl-2-pyrazoline lactone.

Compound K

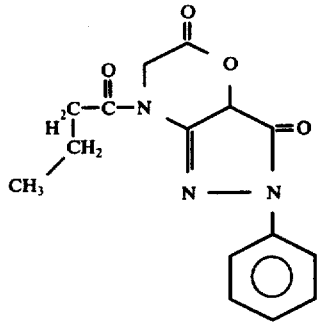

α-(2-carboxybenzoyl)-α-hydroxyacetonitrile lactone.

Compound L

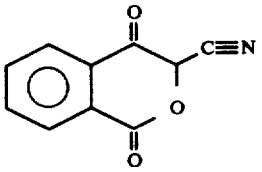

3-(N-n-butyl-N-carboxymethyl)amino-4-hydroxy-5-oxo-1-phenyl-2-pyrazoline lactone.

Compound M

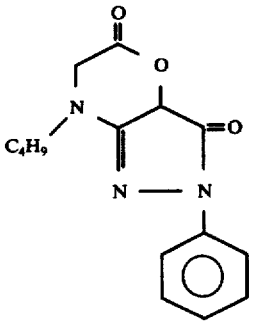

Typical lactone yellow color formers are:
3-carbethoxy-4-hydroxyisocoumarin.

Compound N

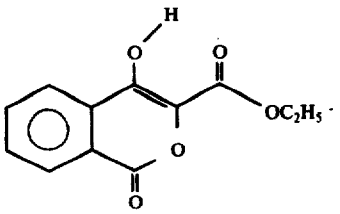

Literature Reference:

D. Molho & J. Aknin, Bull. Soc. Chim, Fr., 2224 (1967).

α-(2-carboxybenzoyl)-α-hydroxyacetanilide lactone.

Compound O

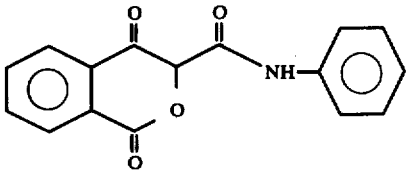

5-Hydroxy-3,3-dimethyl-4-oxo-6-adipanilic acid lactone.

Compound P

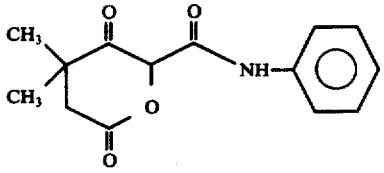

3,3-Dimethyl-2,4-dioxo-5-(N-phenylcarboxamido)-furan.

Compound Q

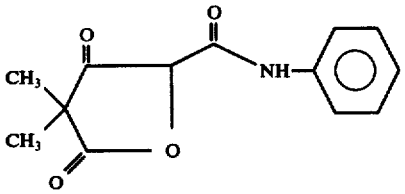

α-Hydroxy-α-pivaloyl-N-(2-carboxyamyl)acetamide lactone.

Compound R

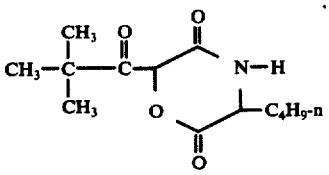

N-n-Butyl-2,5-dioxo-6-pivaloylmorpholine.

Compound S

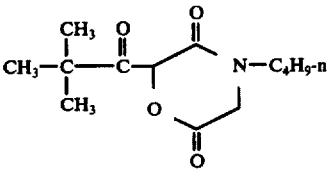

HYDROLYSIS RESISTANT SULTONES

α-Hydroxy-α-(2-sulfobenzoyl)-acetanilide sultone.

Compound T
Yellow

-continued

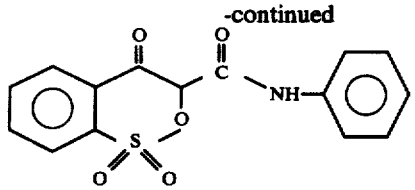

4-Hydroxy-5-oxo-1-phenyl-3-(β-sulfoethyl)-2-pyrazoline sultone.

Compound U
Magenta

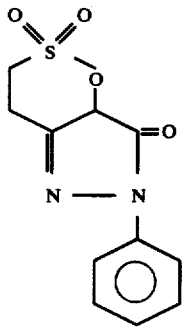

4-Hydroxy-5-oxo-1-phenyl-3-(2-sulfophenyl)-pyrazoline sultone.

Compound V
Magenta

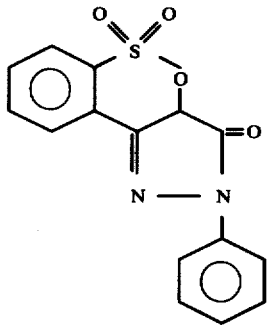

2-Acetamido-5-(2-sulfoethyl)-6-chloro-hydroquinone sultone.

Compound W
Cyan

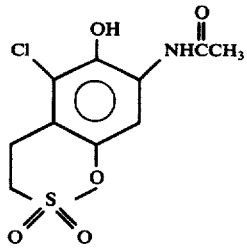

DESCRIPTION OF SILVER STREAM PROCESS EMPLOYING INTRAMOLECULARLY CYCLIZED COUPLERS

The two-equivalent non-diffusing intramolecular couplers of the invention function with such oxidized p-phenylene diamine type developer provided via reaction including the nuclei and undeveloped silver halide derived from only the adjacent photosensitive member to form and set free for solubilization and diffusion the soluble, diffusible dye of a hue complementary to that color of light registered as the negative record. By this mechanism, the dye diffuses not from the silver halide layer, but from the nucleating layer in those areas only adjacent to areas containing undeveloped silver halide. This dye transfer mechanism is triggered by a specific intranegative transfer of this leftover silver halide to the adjacent nucleating layer only. This intranegative transfer step is initiated, in part, by the addition of (following or concurrent with development of the negative record by p-phenylene diamine type developer, in any convenient developer or developer combination) critically small (less than 10 gm/1, but preferably less than 2 gm/1) concentrations of a silver halide solvent such as sodium thiosulfate, or in concentrations equivalent in solvent action, of sodium thiocyanate, or any other equivalent silver solvent.

Our invention is not to be confused with those processes in the prior art, for example, in U.S. Pat. No. 2,352,015 in which it is intended to employ leftover silver halide in one layer to release a dye or color providing substance in an adjacent layer, triggered by a silver halide solvent concentration initiating in whole rather than in part, a non-specific transfer of soluble silver ions to the adjacent color providing layer. At the silver halide solvent levels mentioned in the prior art U.S. Pat. Nos. 2,352,015; 2,673,800; 3,244,001; 3,443,940; etc.) the silver halide is sufficiently solubilized to transfer silver ions eventually to and color providing layer, yielding ghost images of improper hue in addition to the correct positive record of a given silver halide image.

This defect is well documented and is recognized, for example, in U.S. Pat. No. 2,673,800 where inconvenient and complicated means are employed to circumvent it. These inconvenient and complicated means are avoided by the present invention.

Our invention employs silver halide solvent concentrations incapable of causing sufficient solubilization by themselves and would fail to even initiate the transporting mechanisms of the prior art. A better understanding of our invention is to be had by considering the following:

One could not predict beforehand that small concentrations of silver halide solvent which would be expected to be inadequately strong (below 10 grams/liter, but preferably below 2 grams/liter) would suffice to solubilize silver halide at a significant rate for silver ion transfer out of a silver halide containing layer. It has been unexpectedly found that when an immediately adjacent (C to 1.0 micron distant) layer contains a reaction providing species for that silver ion, such as silver reduction, that concentration of silver halide solvent now suffices for a significant mass transfer of silver ions between that layer and the reaction providing layer across the 0–1 micron border.

It has been further found that this effect falls off sharply with distance such that when the reaction providing layer is more remote (3 to 6 microns distant) that critically small concentration of silver solvent once more acts as expected, that is to say, it does not provide sufficient solubilization for significant transfer of silver ions from the silver providing layer to that more distant reaction providing layer and no useful diffusion result is achieved.

This can best be understood by appeal to the thermodynamic concept of chemical potential which is to entropic force fields what electromotive force is to electric force fields; just as mass transfer (i.e. silver ion transfer) is to entropic force fields what current or electron movement is to electric force fields.

It is now apparent that the critically small concentration of silver halide solvent employed does not create by itself(a "push" mechanism), a concentration gradient profile sufficient to set up a chemical potential between adjacent layers large enough for significant transfer of silver ions from one layer to another. It is also now apparent that the reaction providing layer itself cannot, by virtue of its capacity as a sink for silver ions (a "pull" mechanism), generate a concentration profile gradient sufficient to set up a chemical potential between adjacent layers large enough for significant silver ion transfer between the layers; but that the sum of their capacities (a "push-pull" mechanism) does suffice to generate a concentration profile gradient between the adjacent layers large enough for significant silver ion transfer. It is also now apparent that even their summed capacities (the "push-pull" mechanism) for initiating silver ion transfer between silver source and silver reacting layers more remote (3 to 6 microns distant) does not suffice for significant silver ion transfer.

The above thermodynamic argument details the difference between solvent induced silver ion transfer in prior art systems and reaction aided silver ion transfer in these systems. The former is characterized by high silver solvent concentrations sufficient to move silver halide throughout the system with no bearing on the intended reaction site, leading to ghost images. The latter is characterized by sufficiently low solvent concentrations to afford the sink potential of the reaction site to play a significant role in the mss transfer of silver ions, the nearby reaction sites having a distinctly larger effect that those more remote. This mode of intranegative transfer allows for design to limit silver ion transfer to desired intranegative transfers without the acceptance of undesirable intranegative transfers as a penalty.

Though we now recognize these two modes of transfer, the dividing line between the two was crossed as a result of happy and accidental discovery. This cross over line must be found by experimental variations in concentration and distance parameters for the systems involved, such experiments to be detailed below in the examples of the practice of our invention.

In general the parameters defining the reaction aided transfer mode for a given system and silver solvent are not independent of each other, and such mode of transfer is not a function of any one of them. Thus for example, while a low silver solvent concentration of 2 grams/liter might be characteristic of the low levels employed in our invention, a too thin dividing layer between the silver source and an unwanted reaction site might have the effect of triggering an unwanted transfer. Thus, for example, if a spacing layer of from 3 to 6 microns in our invention is combined with too high a silver solvent concentration the unwanted mode of transfer is activated even though the distance parameter is within the scope of our invention.

In usual practice, the distance parameter is set, and a silver solvent concentration is found which lies below the dividing line between these two modes of transfer. This value will, of course, be different for different silver solvents.

It is among the teachings of our invention that when the negative photosensitive package is coated using the above learned distance parameters, and the critically small concentration of silver solvent is not exceeded, that the intranegative transfers will be limited to the following three without complicated means being required to bar other undesirable intranegative transfers: the undeveloped silver halide from the blue record will transfer specifically and solely to the adjacent reaction providing layer affording a diffusible positive yellow image; the undeveloped halide from the green record will transfer specifically and solely to the adjacent reaction providing layer affording a diffusible positive magenta image; and the undeveloped silver halide from the red record will transfer specifically and solely to the adjacent reaction providing layer affording a diffusible positive cyan image. The net effect of the three only intranegative silver transfers is a composite dye transfer to a mordanting receiving sheet yielding a true rendering of the variations in hue, saturation, and density of the original scene.

In FIG. 1, the negative package is shown before processing and during exposure. By legend the conversion of the original scene shown at the top to its proper latent image record is shown. The sensitizers used for the silver halide layers (4, 8 and 12) are well known. In general, the red sensitive dyes are meso substituted carbocyanines and those dyes which sensitize in the J band. These include selenothiomeso ethylcarbocyanines. The green sensitizing dyes are preferably of the pseudocyanine type and give excellent results. Other green sensitizers are the oxacarbocyanine dyes and combinations of these oxacarbocyanine dyes which have been successfully used.

Having properly registered the three records, FIG. 2 and the corresponding portions of the legend shows the action of initiating development and the three only intranegative silver ion transfers.

The negative development takes place with a paraphenylene diamine color developer, the oxidized p-phenylene diamine from this step being scavenged by either reaction by the non-diffusing coupler in layers 4, 8 and 12; by the anti-oxidant in layers 3, 7 and 11; or by nature of its own half life.

Undeveloped silver halide, representing the positive record of layers 4, 8 and 12, respectively, is transferred via three only intranegative transfers to the proper layers 2, 6 and 10 only to initiate a transfer process shown schematically and by legend in FIG. 3.

The 2-equivalent non-diffusing intramolecularly cyclized couplers are indicated by legend in layers 10, 6 and 2, respectively, and are preferably those specifically mentioned herein. These couplers are preferably dispersed in a high boiling solvent.

Subsequent to transfer of the composite dye image in FIG. 3, the receiving sheet is peeled from the negative package, the high alkalinity in the mordant layer being neutralized by layer 16.

The true representation of the original scene (see FIG. 1) may be viewed on the receiving sheet (see FIG. 4).

EXAMPLE I

This example illustrates the use of the Intramolecularly Cyclized Couplers in a tripack instant negative package as shown in detail in FIG. 11 and is used for fast printing from color negatives. For purposes of simplification the yellow Intramolecularly Cyclized Coupler will first be described in substantial detail in Example IA. The magenta Intramolecularly Cyclized Coupler will be described in Example IB and finally the Cyan Intramolecularly Cyclized Coupler will be described in Example IC.

Example IA (Yellow Intramolecularly Cyclized Coupler)

Compound N was dissolved in Phenoxypropanol, 1 part color former to 3 parts oil. The compound in oil was then added to gelatin and dispersed. This dispersion was added to a silver bromo-iodide photographic emulsion. The emulsion was coated on filmbase to a thickness of 5μ. After exposure, the strip was contacted with a mordant sheet using the apparatus described in FIG. 5 and containing developer A. After 1 minute the strips were peeled apart to reveal a yellow negative transfer image with an absorption maximum of the dye at 460nm.

In the same manner, compound O gave a yellow negative transfer image having absorption maximum 445 nm.

Example IB (Magenta Intramolecularly Cyclized Coupler)

Compound F was dissolved in butylacetanilide, dispersed, and then coated as in Example IA. After exposure and development, the strips were separated to reveal a magenta negative transfer image.

Example IC (Cyan Intramolecularly Cyclized Coupler)

Compound A was dissolved in 1/1 phenoxypropanol/cellosolve acetate, dispersed, and then coated as in Example IA. After exposure and contact development, the strips were peeled apart to reveal a cyan negative transfer image with absorption maximum at 654 nm.

The Negative Tripack based on FIG. 11 may be prepared by stacking the configurations of Examples 1A, 1B and 1C where 1B and 1C are sensitized to green and red light, respectively, and coated as shown on FIG. 11.

| Developer A | |
|---|---|
| Sodium sulfite | 4.0 g |
| 4-diethylamino-2-methylaniline mono hydrochloride (CD-2) | 5.0 g |
| 4-(N-ethyl-N-β-hydroxyethyl)amino-2-methyl-aniline sulfate (CD-4) | 5.0 g |
| Nitrilotriacetic acid | 5.0 g |
| Alipal ® CO 436 | 0.83 ml |
| Benzyl alcohol | 1.0 ml |
| Potassium Hydroxide (45%) | 25 ml |
| Boric Acid | 18 g |
| Sodium Chloride | 2.5 g |
| Hydroxylamine sulfate | 2.0 g |
| Phenidone B | 0.125 g |
| Metol | 0.125 g |
| Water to | 1 liter |
| pH = 10.7 | |

Alipal CO 436 - Ammonium salt of a sulfated nonyl phenoxy poly(ethylene oxy)ethanol sold by GAF

EXAMPLE II

This example illustrates the positive working system of FIGS. 1 and 2.

In the positive working system shown in FIGS. 1 and 2, the light sensitive negative material is coated as follows:

Layer 1—An opaque film base support of a material such as polyester, or thermoplastic cellulose film base material or baryta coated paper or polyethylene-paper laminate.

Layer 2—Compound A is dissolved in phenoxypropanol/ cellosolve acetate in a 1 to 1 ratio and dispersed in gelatin containing colloidal silver (Carey-Lea) and coated to a thickness of 5.0 microns. The coating weight of compound A is 1.0 gram per square meter.

Layer 3—A 1.0 micron separation layer of gelatin or gelatin substitute preferably containing 0.1–3% of an antioxidant such as a substituted hydroquinone, e.g., 2,5-ditertiary-amyl hydroquinone.

Layer 4—A red sensitive silver halide photographic emulsion containing a non-diffusing color coupler such as 1-(2,4,6-trichlorophenyl)-3-[3-α-(2,4-ditertiaryamylphenoxy) acetamide benzamido]-5-oxo-2-pyrazoline. The silver halide is coated to a weight of 1.0 gram of silver per square meter and the foregoing coupler is half this coating weight in a layer thickness of 5.0 microns.

Layer 5—Separation layer of gelatin or gelatin substitute of 3.0–6.0 microns thickness.

Layer 6—Magenta color former F dissolved in butylacetanilide and dispersed in gelatin containing colloidal silver (Carey-Lea) and coated to a thickness of 5.0 microns. Except for material F this layer is the same as layer 2.

Layer 7—A 1.0 micron separation layer of gelatin or gelatin substitue, preferably containing 0.1–3% of an antioxidant such as a substituted hydroquinon e.g. 2,5-ditertiary-amyl hydroquinone.

Layer 8—A green sensitive silver halide emulsion containing a non-diffusing color coupler such as 1-(2,4,6-trichlorophenyl)-3-[3-α-(2,4-ditertiaryamylphenoxy) acetamide benzamido]-5-oxo-2-pyrazoline. The silver halide is coated to a weight of 1.0 gram of silver per square meter and the foregoing coupler is half this coating weight, in a layer thickness of 5.0 microns.

Layer 9—Separation layer of gelatin or gelatin substitute of 3.0 to 6.0 microns thickness.

Layer 10 —Yellow color former Compound N dissolved in phenoxypropanol, and dispersed in gelatin containing colloidal silver (Carey-Lea) so that the layer acts as a filter for blue light. Thus, except for Compound N in a solvent this layer is the same as layers 2 and 6.

Color Formers in layers 2, 6, and 10 are in a concentration of 3 parts oil to 1 part of color former but this concentration may vary. Satisfactory proportions of the color formers in these layers are at a level of about 0.2–1.0 grams per square meter.

Layer 11—A 1.0 micron separation layer of gelatin or gelatin substitute preferably containing 0.1–3% of an antioxidant such as a substituted hydroquinone, e.g., 2,5-ditertiary-amyl hydroquinone. Note that layers 3, 7 and 11 are generally identical.

Layer 12—A blue sensitive silver halide emulsion containing a non-diffusing color coupler such as 1-(2,4,6-trichlorophenyl)-3-[3-α-(2,4-ditertiaryamylphenoxy) acetamide benzamido]-5-oxo-2-pyrazoline. The silver halide (bromo-iodo) is coated to a weight of 1.0 gram of silver per square meter and the foregoing coupler is half this coating weight in a layer thickness of 5.0 microns. Note that layers 4, 8 and 12 are sensitized differently but otherwise similar.

Layer 13—Layer 13 is formed of gelatin or gelatin substitute.

| Developer B | |
|---|---|
| Sodium sulfite | 4.0 g |
| 4-diethylamino-2-methylanilide mono hydrochloride (CD-2) | 5.0 g |
| 4-(N-ethyl-N-β-hydroxethyl)amino-2-methyl-aniline sulfate (CD-4) | 5.0 g |
| Nitrilotriacetic acid | 5.0 g |
| Alipal ® CO 436 | 0.83 ml |
| Benzyl alcohol | 1.0 ml |
| Potassium Hydroxide (45%) | 25 ml |
| Boric Acid | 18 g |
| Sodium chloride | 2.5 g |
| Hydroxylamine sulfate | 2.0 g |
| Sodium Thiosulfate | 0.5 g |
| Water to | 1 liter |
| pH = 10.7 | |

A viscosity increasing agent such as methyl cellulose may be added.

DETAILS OF PROCESSING OF EXAMPLE 2

The foregoing negative package is exposed imagewise and is then contacted with a mordanting sheet of the generic type which is composed of layers 15, 16 and 17 as illustrated and described in FIG. 5, this apparatus containing developer B. The specific mordant which is used in this example is Triton X-400 which is stearyl benzyl dimethylammonium chloride available from Rohm and Haas, Philadelphia, Pennsylvania. A positive three-color transfer image is obtained.

EXAMPLE III

This example illustrates the use of the Intramolecularly Cyclized Couplers in a tripack direct positive material as shown in detail in FIG. 11.

EXAMPLES IIIA, IIIB and IIIC

Examples 1A, 1B and 1C are repeated except that in place of the conventional silver bromo-iodide photographic emulsion of 1A, a direct positive emulsion is used, such as described in U.S. Pat. No. 2,501,307 and 3,635,707. A Direct Positive Tripack based on FIG. 11 may be prepared by stacking the configurations of Examples IIIA, IIIB and IIIC, when IIIB and IIIC are sensitized to green and red light, respectively, and coated as shown in FIG. 11.

This tripack is exposed imagewise and then contacted with a mordanting sheet as described in Example II, except that Developer A from Example I is used in place of Developer B. A positive three-color transfer image is obtained.

GENERAL METHOD OF PREPARATION OF HYDROLYSIS RESISTANT SULTONES

The general method is known and is described in U.S. Pat. No. 3,415,652 but the compounds made therein are not employed in the novel manner of the present invention.

The following general procedure is to be read in conjunction with the aforesaid patent as a guide to prepare the desired compounds.

Starting from Omega bromoalkyl sulfonates, in the form of the alkali metal salt or silver salt, and heating to elevated temperature in an inert solvent such as DMF, nitrobenzene, chlorobenzene, or the like, a cyclization occurs with the elimination of metal halide which precipitates to produce the sultone which is soluble in the inert solvent and is separated in known manner after filtering off the metal halide salt. Obviously those intermediates which produce hydrolysis resistant sultones must be employed and the above examples illustrate such intermediates.

The 2-equivalent couplers which comprise the sultone compounds must be hydrolysis resistant under alkaline development condition which is encountered during the processing reaction when the developer reacts with the coupler to give the yellow, magenta or cyan color dyes.

What is claimed is:

1. In a color diffusion transfer process carried out in a photographic film package having one or more color sensitive silver halide emulsion layers which respond to exposure by actinic radiation from different primary colors and which also contain color couplers yielding dyes of complementary colors to said different color sensitive layers, said film package being coated at a pH below 9, but preferably below pH 7, to provide a storage stable package in which color formers do not diffuse, and said package reacting with an alkaline aqueous processing and developing solution containing a p-phenylene diamine developer, the improvement comprising:

a. providing as the aforesaid color coupler a waterinsoluble, transient heterocyclic 2-equivalent color coupling compound having a lactone or sultone ring, said transient heterocyclic color coupling compound being resistant to splitting of said ring in alkaline aqueous solution in the absense of oxidative coupling; said transient heterocyclic color coupling compound being a compound of the formula:

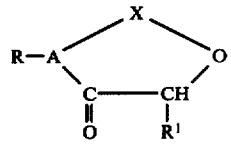

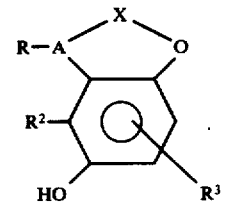

or

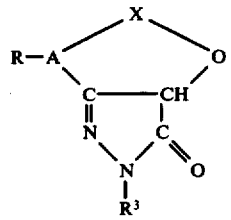

wherein

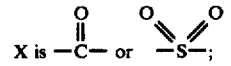

A is a chain of 1 to 3 atoms containing only carbon atoms in the chain or containing up to 1 nitrogen atom for chains of 2 or 3 atoms;

R is attached to and satisfies the valences of the atoms in A and is independently, one or more hydrogen, an aliphatic radical or an aromatic radical, or R is an aromatic radical and A is provided by two adjacent carbon atoms in an aromatic ring of R;

$R^1$ is an activating group associated with a ketomethylene coupler; and $R^2$ and $R^3$ are independently hydrogen, halogen, cyano, an aliphatic radical or an aromatic radical, or R, $R^2$ and A together form a benzene ring fused to the benzene ring to which A and $R^2$ are attached; said transient heterocyclic color coupling compound being incorporated in a high boiling photographically inert oil dispersion to provide droplets having substantially no water solubility and no diffusion at pH below 9, yet being responsive to said alkaline processing and developing solution at pH above 9 to allow reaction of said transient heterocyclic color coupling compound with locally oxidized p-phenylene diamine and to thereby from imagewise water soluble and diffusible dye, the water solubility and diffusibility characteristics being bestowed upon the dye by a newly formed carboxylic or sulfonic acid group as a result of ring opening in coupling position by oxidative coupling reaction, said diffusible dye being free to diffuse out into a mordanted receiving sheet, b. exposing said package in imagewise fashion and c. after exposing developing said package in an alkaline processing solution having a pH above 9 and containing a p-phenylene diamine developer and in contiguous contact with said mordanted receiving sheet.

2. A process as set forth in claim 1 wherein a negative color transfer image is created by utilizing negative silver halide emulsions to form imagewise the oxidized p-phenylene diamine for diffusible dye generation.

3. A process as set forth in claim 1 wherein said transient heterocyclic color coupling compounds are incorporated in the light sensitive silver halide layers.

4. A process as set forth in claim 1 wherein a direct positive transfer image is created by utilizing direct positive silver halide emulsions to form imagewise the oxidized p-phenylene diamine for diffusible dye generation.

5. In a color diffusion transfer process carried out in a package containing one or more photosensitive silver halide emulsion layers containing scavenging color former and developable to the negative record of an actinic image of one primary color, each said layer having a separate companion layer containing physical development nuclei together with a colorless color providing color coupler which produces a diffusible positive record of the complementary color via physical development of non-negative record silver ion crossing from the photosensitive layer for diffusion to a receiving sheet or layer, the improvement comprising:

a. providing as a scavenging color former a non-diffusing 4-equivalent coupler which couples with and removes from further action the oxidized p-phenylene diamine developer produced in the development of the negative record, said coupled product being non-diffusing, b. providing as the aforesaid color coupler a waterinsoluble, transient heterocyclic 2-equivalent color coupling compound having a lactone or sultone ring, said transient heterocyclic color coupling compound being resistant to splitting in alkaline aqueous solution in the absense of oxidative coupling; said transient heterocyclic color coupling compound being a compound of the formula:

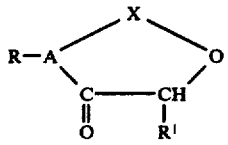

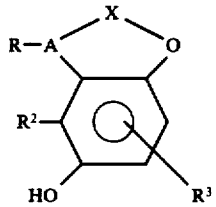

or

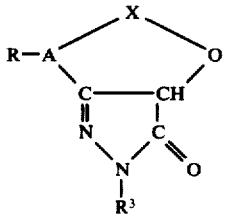

wherein

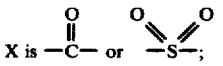

A is a chain of 1 to 3 atoms containing only carbon atoms in the chain or containing up to 1 nitrogen atom for chains of 2 or 3 atoms;

R is attached to and satisfies the valences of the atoms in A and is independently, one or more hydrogen, an aliphatic radical or an aromatic radical, or R is an aromatic radial and A is provided by two adjacent carbon atoms in an aromatic ring of R;

$R^1$ is an activating group associated with a ketomethylene coupler; and $R^2$ and $R^3$ are independently hydrogen, halogen, cyano, an aliphatic radical or an aromatic radical, or R, $R^2$ and A together form a benzene ring fused to the benzene ring to which A and $R^2$ are attached;

said transient heterocyclic color coupling compound being incorporated in a high boiling photographically inert oil dispersion to provide droplets having substantially no water solubility and no diffusion at pH below 9, yet being responsive to said alkaline processing and developing solution at pH above 9 to allow reaction of said transient heterocyclic coupler compound with locally oxidized p-phenylene diamine provided by physical development of the non-negative silver ion record crossing from the photosensitive layer and to thereby form imagewise water soluble and diffusible dye, the water solubility and diffusibility characteristics being bestowed upon the dye by a newly formed carboxylic or sulfonic acid group as a result of ring opening in coupling position by oxidative coupling reaction, said diffusible dye being free to diffuse out into a mordanted receiving sheet, c. exposing said package, d. processing said exposed package in an alkaline processing solution having a pH above 9 and containing a p-phenylene diamine developer and a silver halide solvent contiguous with the presence of a receiving layer or sheet.

6. A process set forth as in claim 5 wherein said package contains two or more photosensitive layers and their companion color providing layers wherein the concentration of silver halide solvent is limited to that amount which will transport the non-negative record silver ion to the nearby complementary color producing layer and not to a more remote color producing layer properly companion to another photosensitive layer.

7. A process as set forth in claim 1 wherein the cyclized 2-equivalent color coupler is 3-(2-carboxy-1-phenyl)-ethyl hydroquinone lactone.

8. A process as set forth in claim 1 wherein the cyclized 2-equivalent color coupler is 3-(2-carboxy-pheny)-4-hydroxy-5-oxo-1-phenyl-2-pyrazoline lactone.

9. A process as set forth in claim 1, wherein the cyclized 2-equivalent color coupler is 3-carbethoxy-4-hydroxyisocoumarin.

10. A process as set forth in claim 5 wherein the cyclized 2-equivalent color coupler is 3-(2-carboxy-1-phenyl)-ethyl hydroquinone lactone.

11. A process as set forth in claim 5 wherein the cyclized 2-equivalent color coupler is 3-(2-carboxy-phenyl)-4-hydroxy-5-oxo-1-phenyl-2-pyrazoline lactone.

12. A process as set forth in claim 5 wherein the cyclized 2-equivalent color coupler is 3-carbethoxy-4-hydroxyisocoumarin.

13. The process according to claim 1, wherein $R^1$ is cyano, acyl, alkoxyacyl or aminoacyl and $R^2$ and $R^3$ are hydrogen, chloro, bromo, alkyl, alkoxy, aliphatic or aromatic acylamino, phenyl, phenoxy, or phenyl substituted by halo, cyano, alkyl, alkoxy, phenyl or phenoxy.

14. The process according to claim 5, wherein $R^1$ is cyano, acyl, alkoxyacyl or aminoacyl and $R^2$ and $R^3$ are hydrogen, chloro, bromo, alkyl, alkoxy, aliphatic or aromatic acylamino, phenyl, phenoxy, or phenyl substituted by halo, cyano, alkyl, alkoxy, phenyl or phenoxy.

* * * * *